US006290370B1

(12) United States Patent
Bouffay et al.

(10) Patent No.: US 6,290,370 B1
(45) Date of Patent: Sep. 18, 2001

(54) PORTABLE ELECTRIC TORCH

(75) Inventors: Boris Bouffay, Grenoble; Paul Petzl, Barraux, both of (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 09/421,388

(22) Filed: Oct. 20, 1999

(30) Foreign Application Priority Data

Nov. 4, 1998 (FR) ..... 98 14036

(51) Int. Cl.[7] ..... F21L 4/00
(52) U.S. Cl. ..... 362/203; 362/208
(58) Field of Search ..... 362/205, 203, 362/197, 208

(56) References Cited

U.S. PATENT DOCUMENTS 4,286,311 * 8/1981 Maglica ..... 362/205
4,709,309 11/1987 Yamaki .
6,050,699 * 4/2000 Bouffay et al. ..... 362/203

FOREIGN PATENT DOCUMENTS 2 755 497-A1 5/1998 (FR) .

* cited by examiner

*Primary Examiner*—Laura K. Tso
(74) *Attorney, Agent, or Firm*—Oliff & Berridge, PLC

(57) ABSTRACT

The torch comprises a support device shaped as a swivelling flap made of insulating material, pivotally mounted on a spindle between an inactive position allowing access to the batteries via the orifice after the reflector sub-assembly has been removed, and an active position in which the terminals are in contact with the poles of the batteries, said spindle extending orthogonally with respect to the longitudinal axis of the end-piece.

11 Claims, 12 Drawing Sheets

PORTABLE ELECTRIC TORCH

BACKGROUND OF THE INVENTION

The invention relates to a portable electric torch comprising a housing containing:

an intermediate wall sub-dividing the inside of the housing into a first compartment containing the batteries and a second compartment having an orifice bounded by an end-piece with a threaded external lateral surface, a reflector sub-assembly screwed onto the end-piece to seal off the second compartment, and a common support device of the electric bulb and of an electrical switch controlling lighting, said device being housed in the second compartment.

1. State of the Prior Technique

A known torch of the kind mentioned is described in the document FR-A-2,708,714. The torch comprises a lighting system with two bulbs, lighting of each bulb being controlled selectively by a control selector. A second operating button enables the distance of one of the bulbs with respect to the reflector to be adjusted to adjust the light beam.

According to the document FR-A-2,755,497, a rotating cylinder with a ramp is equipped with a pushbutton designed to operate in conjunction with a stop of the reflector for control of the switch.

2. Object of the Invention

The object of the invention is to achieve a waterproof portable torch allowing the batteries to be replaced easily via the front face.

The electric torch according to the invention is characterized in that the support device is shaped as a swivelling flap made of insulating material, pivotally mounted on a spindle between an inactive position allowing access to the batteries via the orifice after the reflector sub-assembly has been removed, and an active position in which the switch is in electrical contact with the poles of the batteries, said spindle extending orthogonally with respect to the longitudinal axis of the end-piece.

According to a preferred embodiment, the body of the flap is equipped with a socket for housing the bulb, and securing means designed to operate in conjunction with notches of the end-piece to lock the flap in the active position.

The flap houses the switch having a movable contact element actuated from the outside of the housing by an operating button.

The structure of the swivelling flap enables a good contact pressure to be obtained for power supply of the bulb, and enables the switch to be incorporated in the internal volume of the flap.

According to one feature of the invention, the movable contact element is formed by a flexible conducting wire operating in conjunction With an insulating operating rod to make or break the power supply circuit of the bull.

According to another feature of the invention, the operating rod is secured to a crown-wheel link to form a monoblock insulating part extending inside the first compartment.

The spindle of the operating button passes radially through a hole of the housing provided with a seal, and is provided at the internal end with a pinion operating in conjunction with the crown-wheel link.

According to another feature, the flap comprises a gripping tab designed to perform unlocking of the securing means before its movement to the inactive position.

According to another feature, the torch comprises a stop catch arranged to block rotation of the reflector sub-assembly at the end of the tightening position on the end-piece.

BRIEF DESCRIPTION OF THE DRAWINGS

Other advantages and features will become more clearly apparent from the following description of an embodiment of the invention, given as a non-restrictive example only and represented in the accompanying drawings in which.

DESCRIPTION OF A PREFERRED EMBODIMENT

Figure 1:
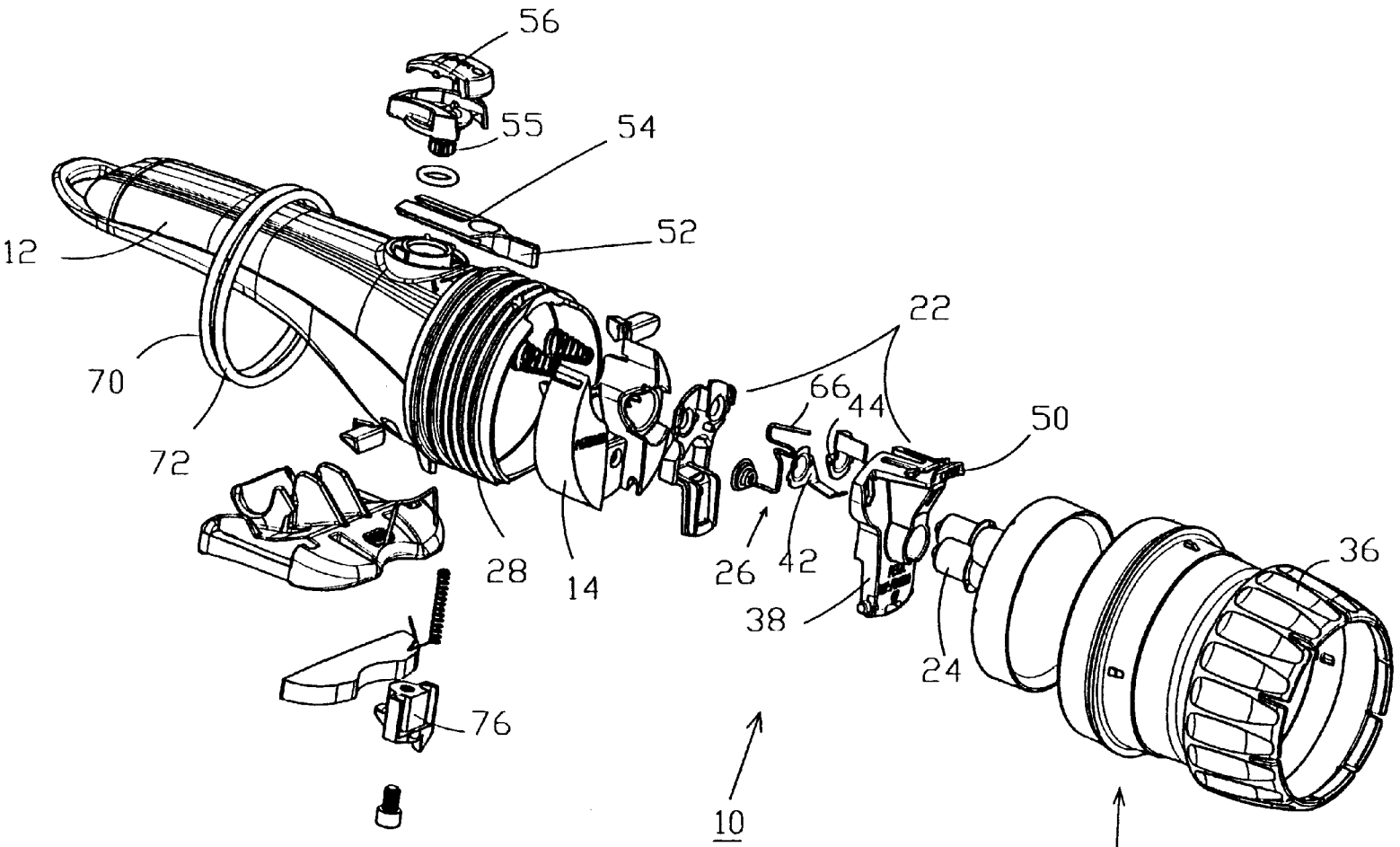
FIG. 1 is an exploded perspective view of the torch according to the invention.

With reference to the figures, a portable electric torch 1 comprises a housing 12 made of molded plastic material, the inside of which is sub-divided by an intermediate wall 14 into a first compartment 16 containing the batteries 18 and a second compartment 20 housing a common support device 22 of the electric bulb 24 and of the electrical switch 26.

The second compartment 20 comprises an orifice 21 situated opposite the wall 14 and bounded by a cylindrical end-piece 28, whose external lateral surface is threaded.

A reflector sub-assembly 30 comprises a reflector 32, a transparent shield 34 and a rotating ring 36 designed to be screwed onto the threading of the end-piece 28 to seal off the second compartment 20.

The support device 22 is formed by a cover shaped as a flap 38 pivotally mounted around a spindle 40 which extends orthogonally with respect to the longitudinal axis of the end-piece 28. The flap 38 made of insulating material can swivel between an inactive position (FIG. 2) allowing access to the batteries 18 and an active position (FIG. 3) in which the terminals 42, 44 of the switch 26 are in contact with the poles of the batteries 18.

The pivoting travel of the flap 38 is about 90°, enabling the batteries 18 to be replaced via the front face of the orifice 21 when the flap 38 is in the inactive position, and after the reflector sub-assembly 30 has been removed. The body of the flap 38 is equipped with a pair of securing spigots 46 designed to operate in conjunction with notches 48 of the end-piece 28 to lock the flap 38 in the active position. The flap 38 bears a gripping tab 50 actuation of which in the radial direction releases the spigots 46 from the notches 48 to perform unlocking of the flap 38 before its movement by pivoting to the inactive position.

Switching of the switch 26 is performed by means of an operating rod 52 actuated by means of a crown-wheel transmission 54, which is driven in translation from outside by a pinion 55 secured to an operating button 56. The operating rod 52 is secured to the crown-wheel link 54 and constitutes a monoblock insulating part extending inside the first compartment 16. The axis of the button 56 passes radially through a circular hole 58 of the housing 12 fitted with a seal 60.

Figure 10A:
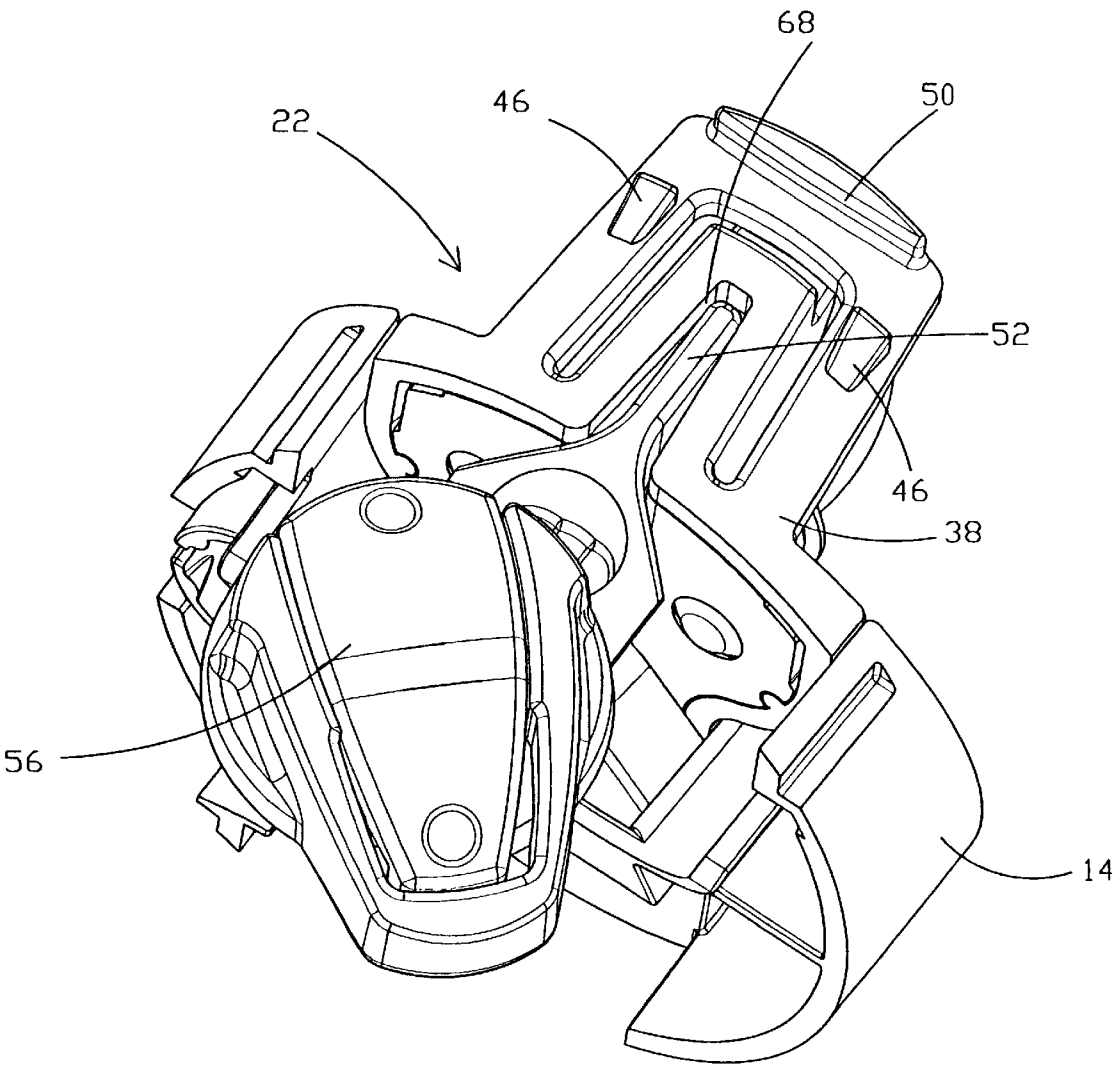
FIGS. 10A and 11A are top views of the operating rod of the switch, respectively when the operating button is in the open position and in the closed position.
Figure 10B:
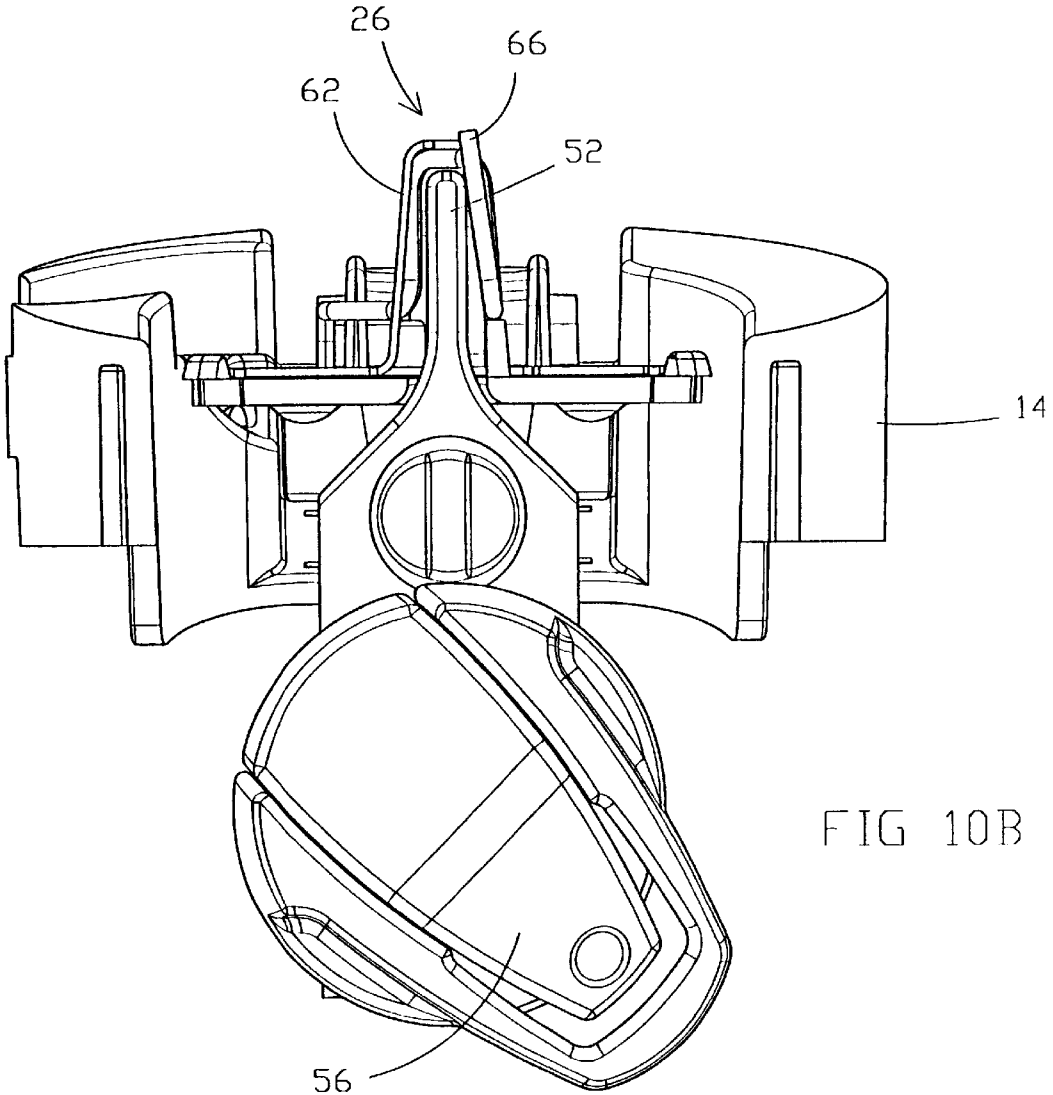
FIGS. 10B and 11B are identical views to FIGS. 10A and 11A representing the movable contact element of the switch in the open position and in the closed position.
Figure 11A:
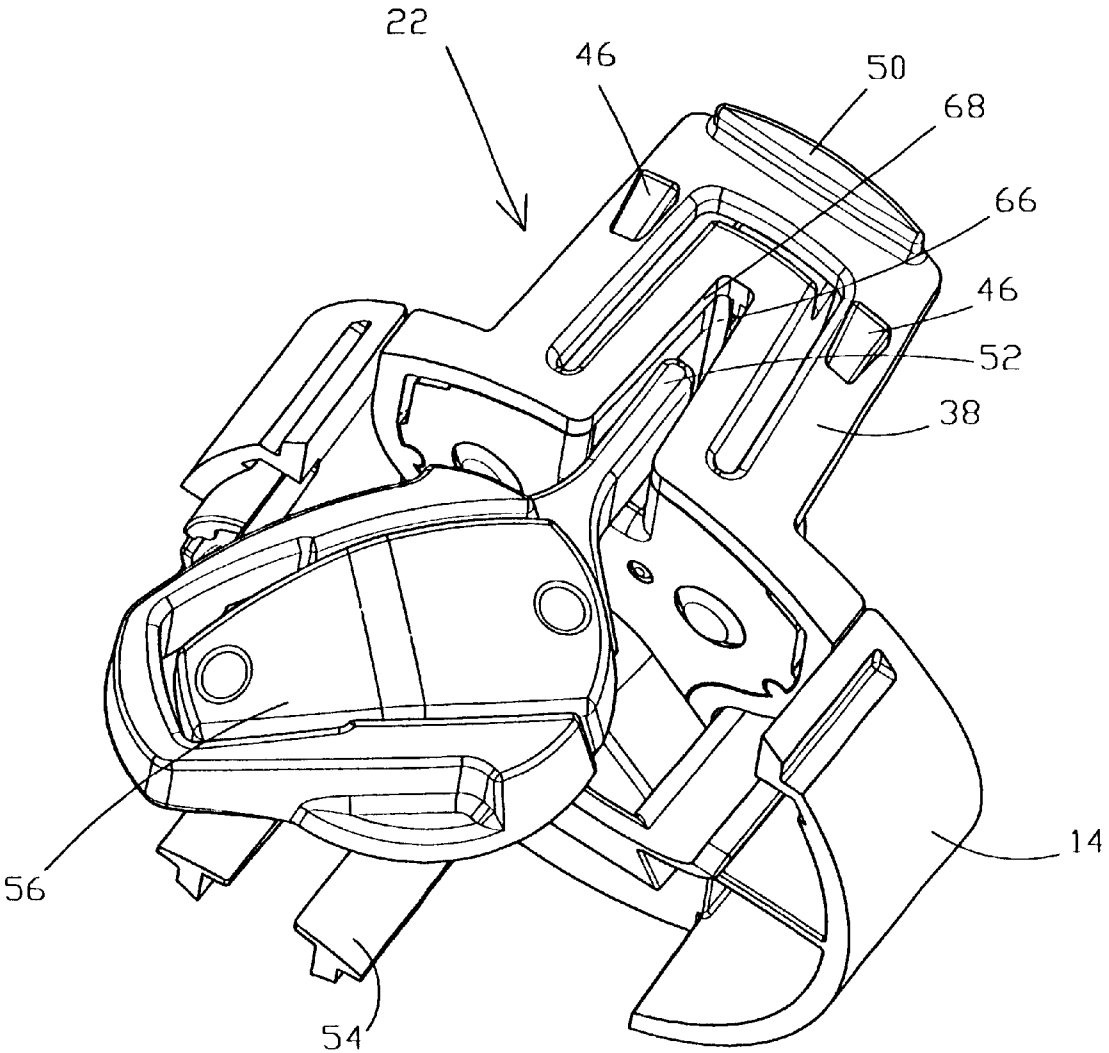
Figure 11B:
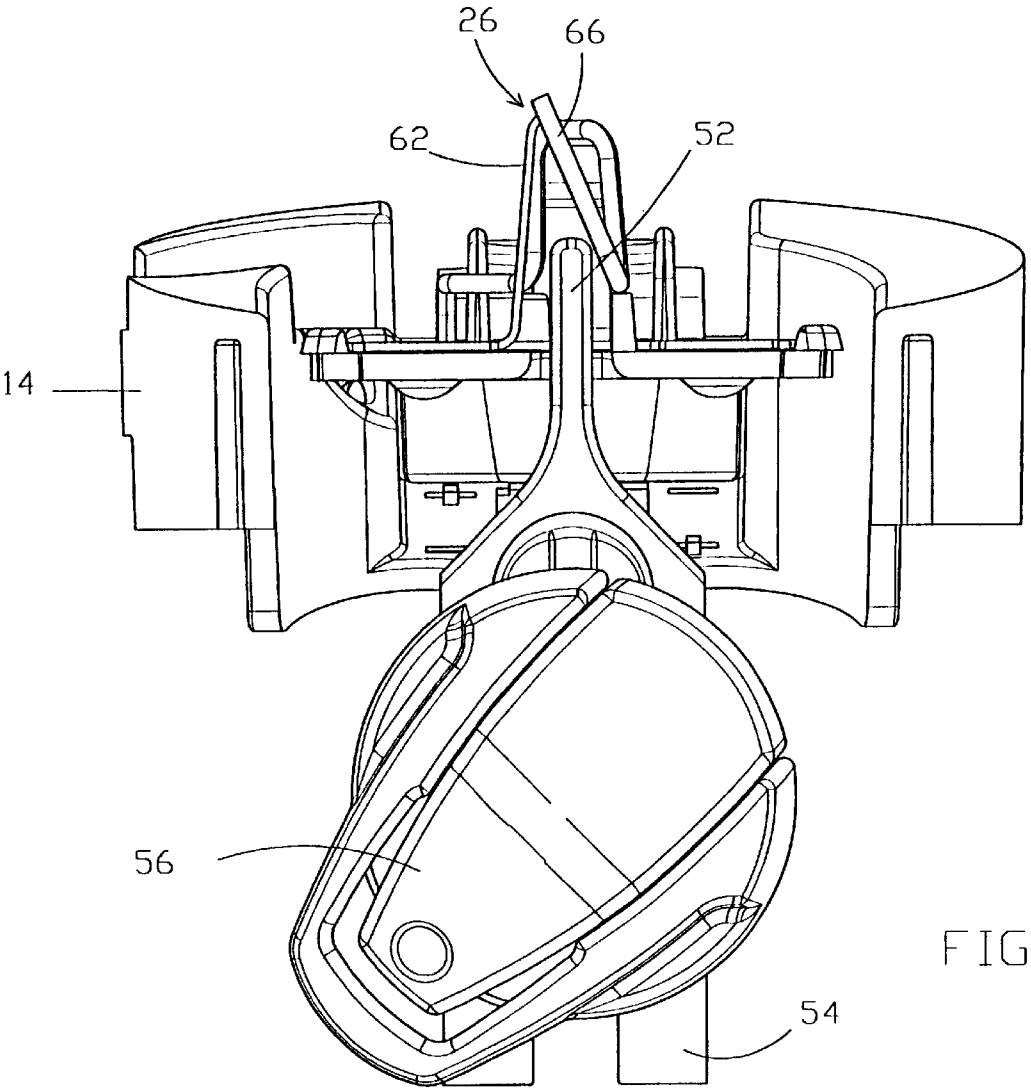
Figure 12:
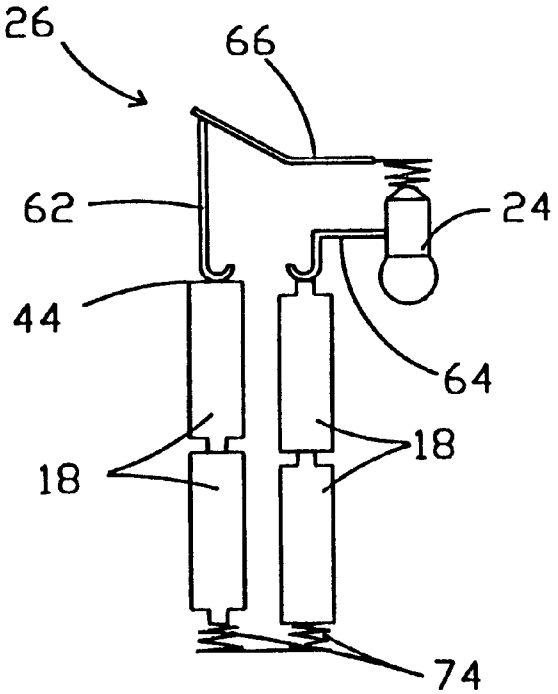
FIG. 12 represents the electrical wiring diagram of power supply of the torch.

With reference to FIG. 12, the switch 26 is housed inside the flap 38 and comprises a first conductor 62 connected to one of the terminals 44. A second conductor 64 is permanently in contact with the ground of the bulb 24 and the terminal 42. A wire 66 made of flexible conducting material acts as movable contact element operating in conjunction with the operating rod 52 to make or break the power supply circuit of the bulb 24. In FIGS. 10A and 10B, the operating rod 52 engages in a notch 68 of the flap 38 and pushes the wire 66 aside to move the switch 26 to the open position. In FIGS. 11A and 11B, reverse pivoting of the button 56 causes withdrawal of the operating rod 52 causing closing of the switch 26.

The tightness of the torch 10 at the level of the reflector sub-assembly 30 is achieved by means of two O-rings 70, 72 housed in grooves of the end-piece 28.

A spring 74 with double winding is fitted opposite the wall 14 between the base of the housing 12 and the batteries 18 so as to perform electrical connection of the two rows of batteries 18 in series, and to provide the contact pressure with the terminals 42, 44 when the flap 38 is in the active position. A stop catch 76 (FIG. 5) enables the reflector sub-assembly 30 to be blocked in rotation in the end of tightening position. To unscrew the ring 36, the catch 76 simply has to be pushed beforehand after the stop screw 75 has been unscrewed to perform unscrewing of the reflector sub-assembly 30.

Figure 2:
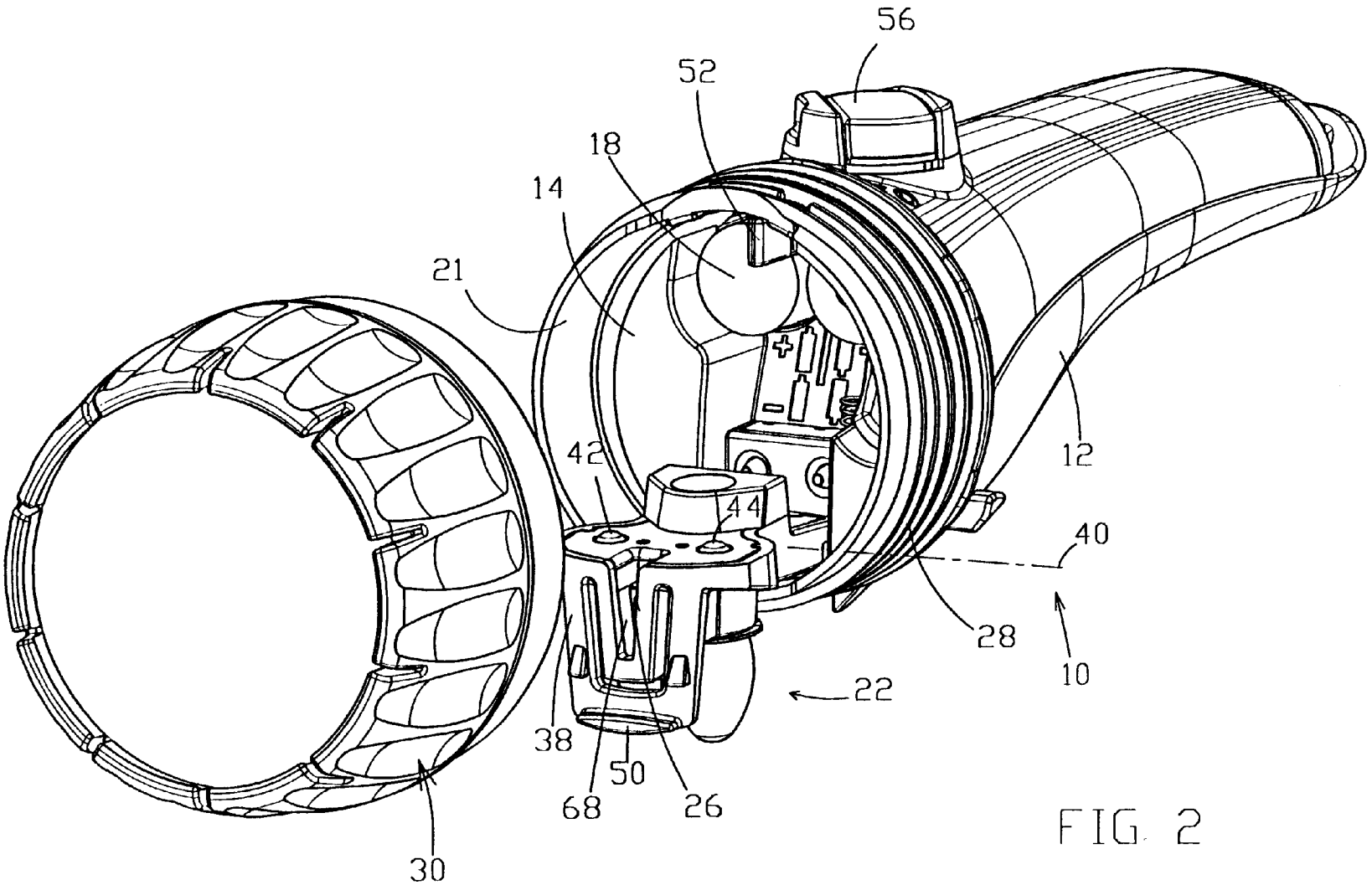
FIGS. 2 and 3 are perspective views of the front part of the torch, respectively in the inactive position and in the active position of the swivelling flap, after the reflector sub-assembly has been removed.
Figure 3:
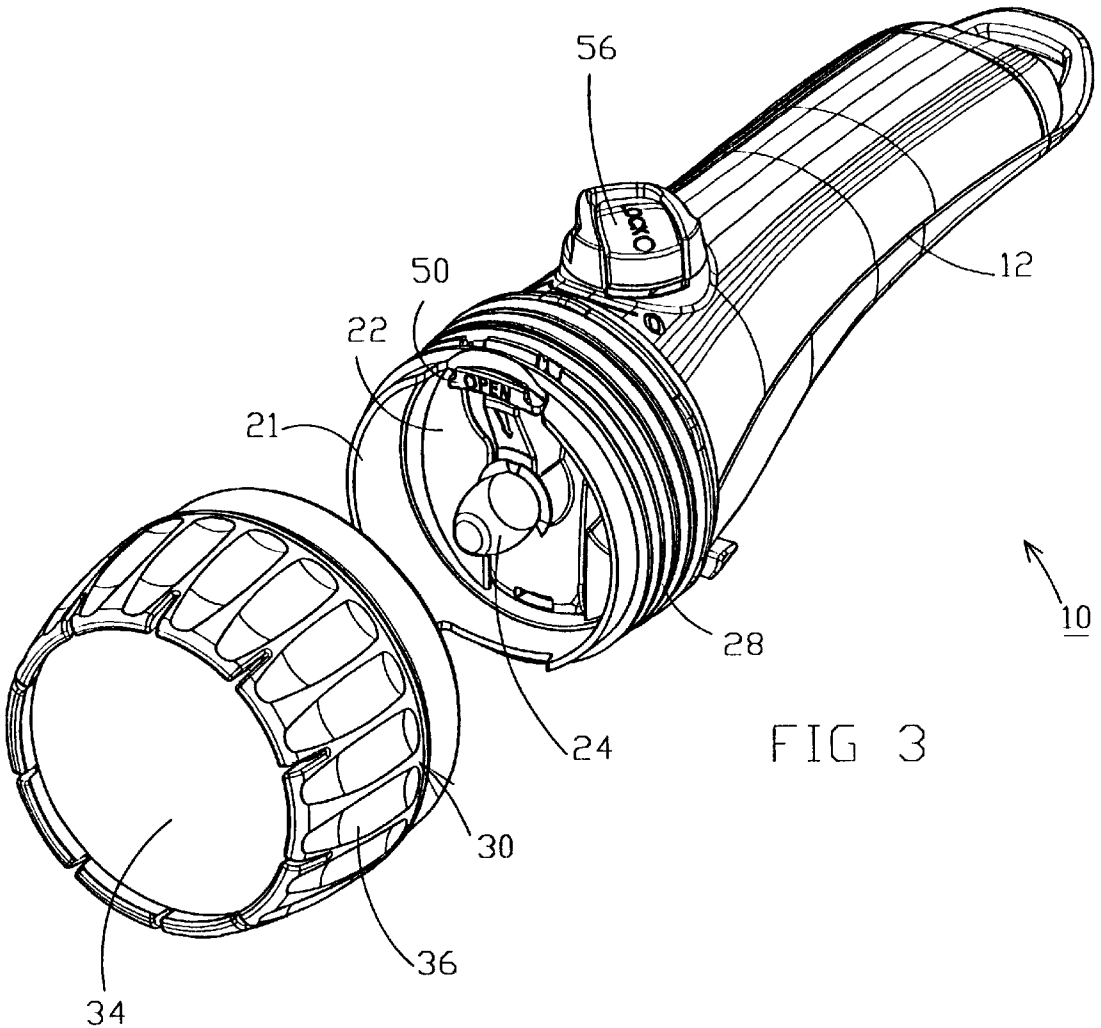
Figure 4:
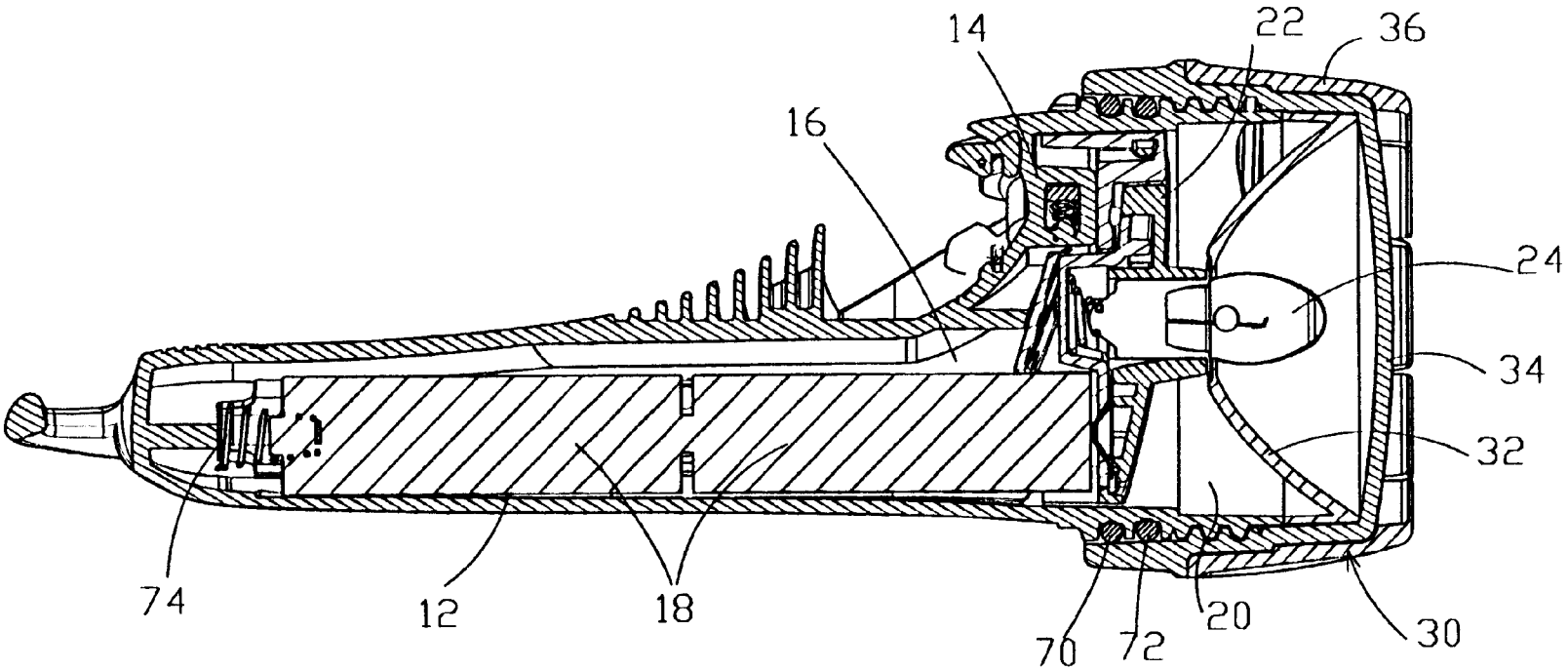
FIG. 4 is a cross-sectional view of the bulb according to a longitudinal line passing through a row of batteries.
Figure 7:
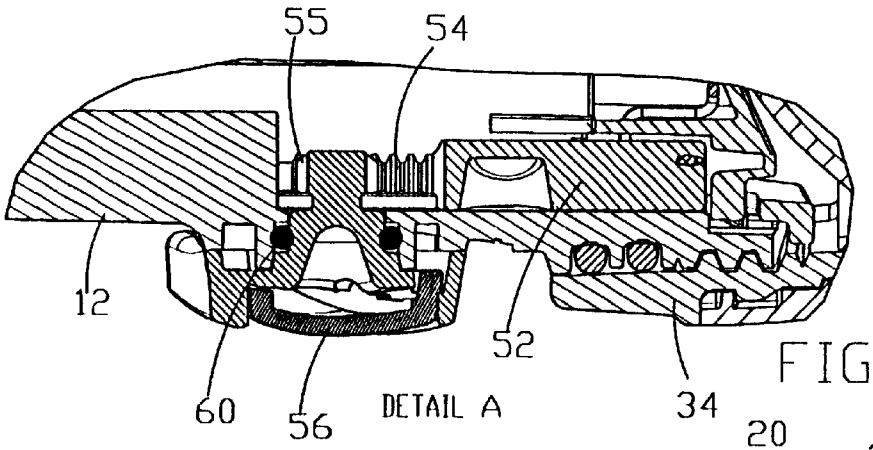
FIG. 7 shows a partial enlarged scale view of a detail A of FIG. 5.
Figure 6:
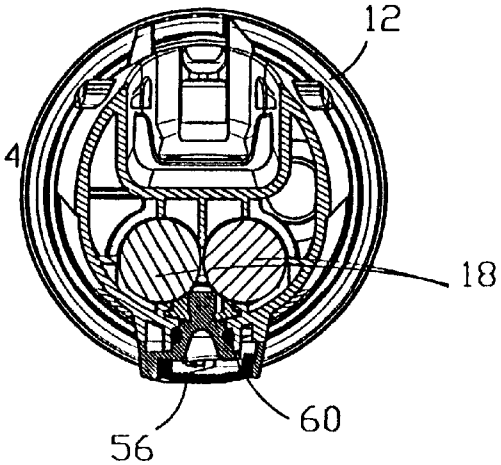
FIG. 6 is a cross-sectional view along the line 6—6 of FIG. 5.
Figure 8:
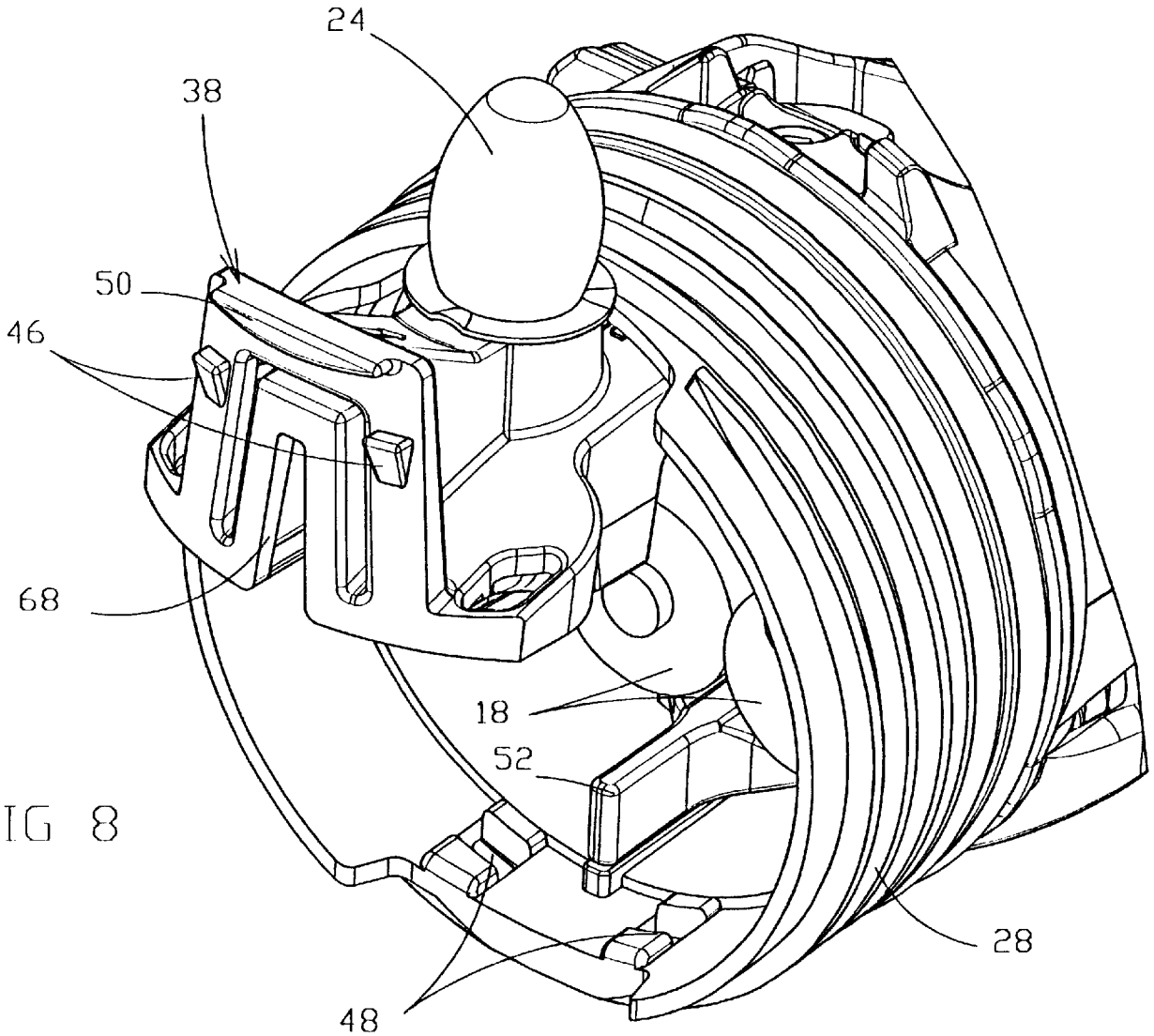
FIG. 8 represents a partial perspective view of the end-piece of the body, equipped with the flap in the inactive position.
Figure 9:
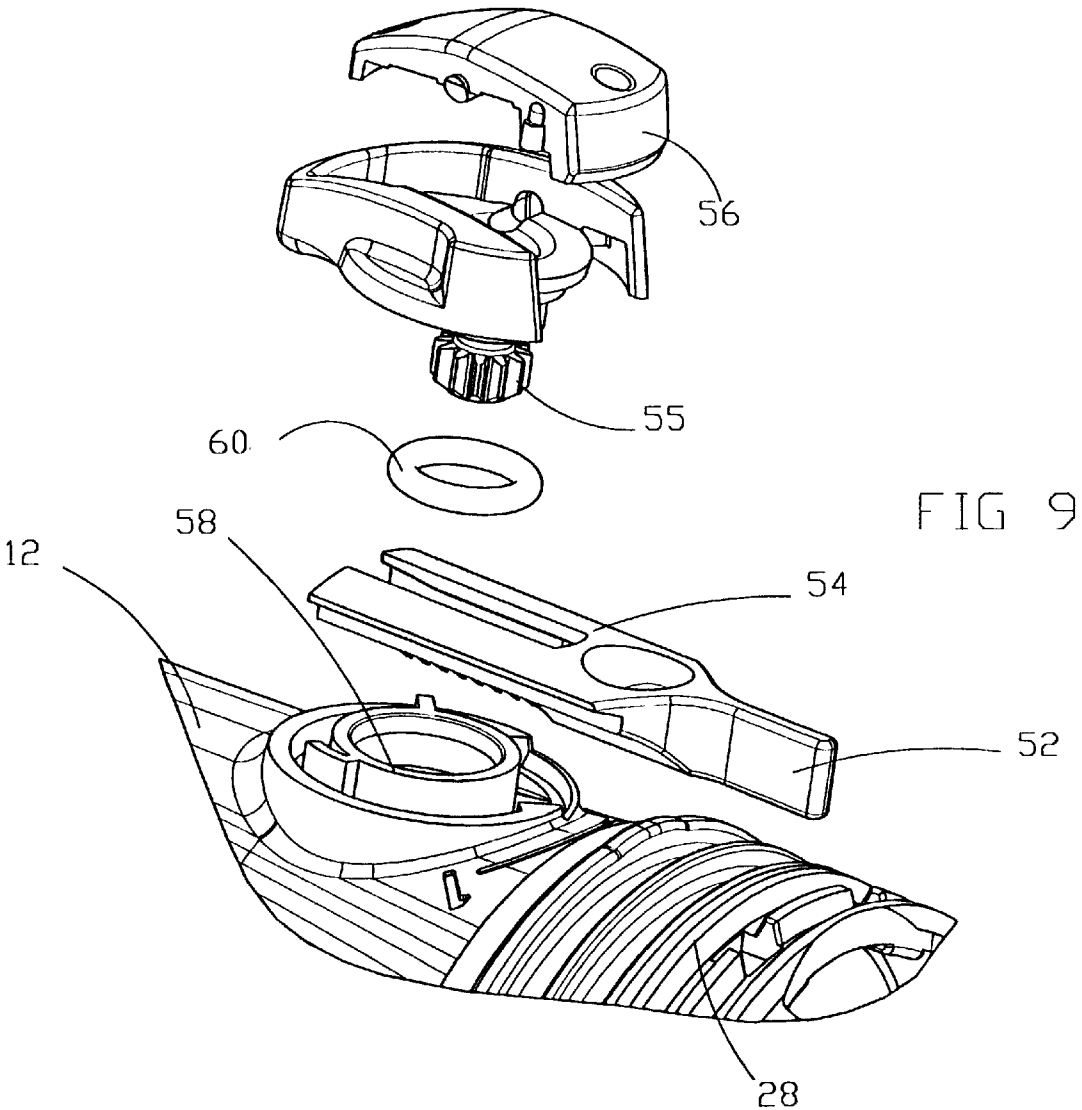
FIG. 9 is an exploded perspective view of the operating button of the switch.

Replacement of the batteries 18 is performed in the following manner:

After the reflector sub-assembly 30 has been removed, the gripping tab 50 is actuated to move the pivoting flap 38 to the inactive position (FIGS. 2 and 8). The terminals 42, 44 are separated automatically from the upper poles of the batteries 18 to break the power supply of the bulb 24 regardless whether the switch 26 is in the open or closed state.

The new batteries 18 are then inserted via the orifice 21 in the front face of the housing 12 in the first compartment 16, bearing on the spring 74. Stacking of the batteries 18 is performed in two parallel rows forming a series circuit. Reclosing of the flap 38 around the spindle 40 to the active position (FIG. 3) causes a limited compression movement of the batteries 18 to ensure a good contact pressure of the terminals 42, 44 on the conductors 62, 64, and between the batteries 18 of each row.

Figure 5:
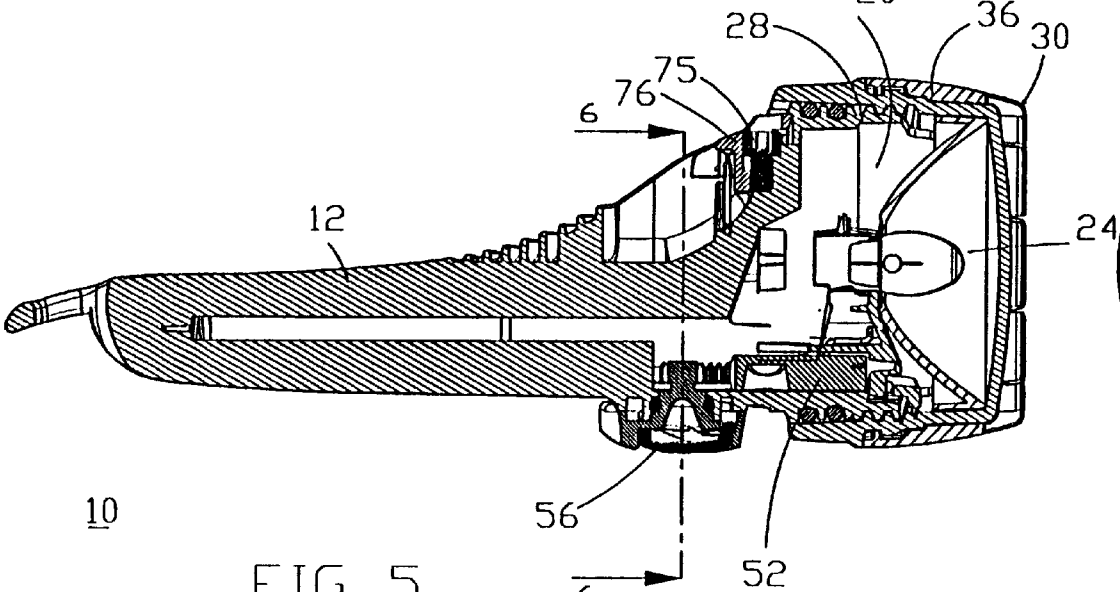
FIG. 5 is an axial cross-sectional view of the bulb according to a longitudinal line passing between the two rows of batteries.

The reflector sub-assembly 30 then simply has to be screwed back onto the end-piece 28 with locking at the end of travel by the catch 76 and stop screw 75 (FIG. 5).

The presence of the O-rings 70, 72 on the end-piece 28 and of the seal 60 on the button 56 enables a good tightness of the housing 12 to be obtained, respectively at the level of the orifice 21 and of the hole 58.

Actuation of the button 56 to the left (FIG. 10A) causes the rod 52 to be engaged in the notch 68 of the flap 38, followed by opening of the switch 26 to extinguish the bulb 24. Lighting of the bulb 24 is achieved by actuating the button 56 to the right (FIG. 11A) causing withdrawal of the rod 52 and closing of the switch 26.

What is claimed is:

1. A portable electric torch, comprising:

a torch housing containing an intermediate wall that subdivides an inside portion into a first compartment containing batteries with poles orientated along a longitudinal axis of the housing and a second compartment having an orifice bounded by an end-piece with a threaded external lateral surface;

a reflector subassembly screwed onto the end-piece of the torch housing to seal off the second compartment; and a common support device housed in the second compartment, the common support device supporting an electric bulb on one side of the support device facing the reflector subassembly and an electrical switch on an opposite side facing the first compartment, wherein the support device is pivotally mounted to the second compartment between an inactive position that allows access to the batteries after removal of the end-piece and reflector subassembly, and an active position that places the electrical switch in electrical contact with the poles of the batteries.

2. The portable electric torch according to claim 1, wherein the support device is mounted to the second compartment by a spindle oriented orthogonal to the longitudinal axis of the torch housing.

3. The portable electric torch according to claim 1, wherein the support device is made of an insulating material.

4. The portable electric torch according to claim 1, wherein the support device has a socket for housing the electric bulb and a securing means that operates in conjunction with the end-piece to lock the support device in the active position.

5. The portable electric torch according to claim 1, wherein the electrical switch includes a movable contact element actuated from outside of the torch housing by an operating button.

6. The portable electric torch according to claim 5, wherein the movable contact element is formed by a flexible conducting wire operating in conjunction with an insulating operating rod to make or break a power supply connection to the bulb.

7. The portable electric torch according to claim 6, wherein the operating rod is secured to a crown-wheel link to form a monoblock insulating part extending inside the first compartment.

8. The portable electric torch according to claim 7, wherein the operating button passes radially through a hole of the torch housing and includes a pinion operating in conjunction with the crown-wheel link, a seal being provided between the operating button and the pinion.

9. The portable electric torch according to claim 1, wherein a compression spring is fitted between a longitudinal end of the first compartment and the batteries to provide a contact pressure with the poles of the batteries when the support device is in the active position.

10. The portable electric torch according to claim 1, wherein the support device further includes a gripping tab.

11. The portable electric torch according to claim 1, further comprising a stop catch to block the reflector subassembly in rotation when the reflector subassembly is fully tightened onto the end-piece.

* * * * *